United States Patent [19]

Cates

[11] Patent Number: 4,884,813

[45] Date of Patent: Dec. 5, 1989

[54] GOLF CLUB ALIGNMENT DEVICE AND METHOD

[76] Inventor: Glenn F. Cates, Rte. 2, Box 331-A, Fayetteville, Tenn. 37334

[21] Appl. No.: 255,598

[22] Filed: Oct. 11, 1988

[51] Int. Cl.[4] ..... A63B 69/36

[52] U.S. Cl. ..... 273/183 D; 273/163 A; 33/508

[58] Field of Search ..... 273/183 D, 183 E, 183 R, 273/186 A, 186 C, 163 R, 163 A, 164, 194 R, 194 A, 194 B; 33/262, 334, 508

[56] References Cited

U.S. PATENT DOCUMENTS 3,253,829 5/1966 Ford ..... 273/183 D

FOREIGN PATENT DOCUMENTS 430844 6/1935 United Kingdom ..... 273/183 E

*Primary Examiner*—George J. Marlo
*Attorney, Agent, or Firm*—C. A. Phillips

[57] ABSTRACT

A golf club alignment device for recording a sight pattern showing the optimum position of the handle end of a golf club when held by a golfer addressing the ball and for reproducing that position. The device has a sighting barrel that is attached to the shaft of the club in spaced-apart, generally parallel relation. Adjustable linkages between the sighting barrel and the clamp attaching it to the shaft allow movement of the top of the barrel toward and way from the shaft and to the golfer's left and right. The barrel is moved until sets of cross hairs across its top and bottom come into alignment with one another when viewed from above by the golfer. The resulting adjusted barrel position, reflective of optimum location of the club handle, is maintained by securing the barrel against further movement. In subsequent shots, the golfer addressing the ball moves the club handle up or down and to the left or right until the sets of cross hairs are again brought into alignment. This reproduces the original optimum position.

10 Claims, 4 Drawing Sheets

GOLF CLUB ALIGNMENT DEVICE AND METHOD

FIELD OF THE INVENTION

This invention relates generally to golf equipment and more particularly to devices for aligning a golf club and golfer in optimum position.

BACKGROUND OF THE INVENTION

One of the problems faced by golfers is the difficulty of reproducing their optimum stance and club alignment for a given type of shot. In particular, a golfer, in addressing the ball, may hold the handle end of the club too high or too low off the ground or too far to the left or right. Both of these variations can cause the club face to strike the ball at an incorrect angle, resulting in a poor shot. Such variations tend to occur even when the golfer has through practice established an optimum position for the club handle in addressing the ball. The problem is not so much that the golfer is unable to establish the proper position, but that he may be unable to reproduce it consistently. A need thus exists for a device that would record the best position for holding the club handle and provide a reference for guiding the golfer back into that position for subsequent shots.

Various prior art patents are directed to devices for aligning golf clubs. One approach as disclosed in U.S. Pat. No. 4,167,268 employs a sighting device for mounting on a putter, the golfer obtaining a sight picture showing the presence or absence of proper alignment of the putter face with the ball. U.S. Pat. Nos. 4,053,160 and 4,116,448 provide a mirror or reflecting element for observing alignment of the club head with respect to the ball and target. Devices which include a pointer to be aimed at the target are disclosed in U.S. Pat. Nos. 3,262,705; 3,298,693; and 4,306,721. A movable pointer and indicator slot for determining angular deviation after a shot is made are shown in U.S. Pat. No. 4,204,332. These patents are concerned with devices for aligning the club with respect to the ball and/or target, and they fail to disclose a sighting device concerned with recording an optimum position for the club handle when the golfer is addressing the ball and with enabling the golfer to reproduce that position for subsequent shots.

SUMMARY OF THE INVENTION

The present invention is directed to a golf club alignment device including a sighting member having a longitudinal axis and a pair of indicators disposed in spaced-apart relation to the club in spaced-apart, generally parallel relation to the club. Linkage of the sighting member of the club is adjustable to allow for movement in two respects: movement of its top closer to and further away from the shaft, and to the golfer's left and right. In using the device, the golfer assumes a previously established optimum stance and club handle position when addressing the ball. He then moves the sighting member until its axis is aligned so that the indicators provide a predetermined sight pattern when viewed by the golfer from above, with his head in its normal position. Upon attainment of this sight pattern, the sight member is held in fixed position. In using the device for subsequent shots, the golfer addresses the ball normally and views the sighting device from above. To bring the club handle to optimum position, he move sit up or down and to the left or right until the sighting pattern is re-established, thereby guiding the club handle to its desired position.

It is, therefore, an object of this invention to provide a device for aligning a golf club with its handle end in optimum position.

Another object is to provide a device for enabling a golfer to record a sight pattern determined by an optimum position for a golf club handle end when addressing a ball and to reproduce such position in subsequent shots.

Yet another object is to provide a method for enabling a golfer to reproduce a previously determined optimum position for a golf club handle and when addressing the ball.

Other objects and advantages of the invention will be apparent from the following detailed description and claims appended hereto.

DESCRIPTION OF THE PREFERRED EMBODIMENT

Figure 1:
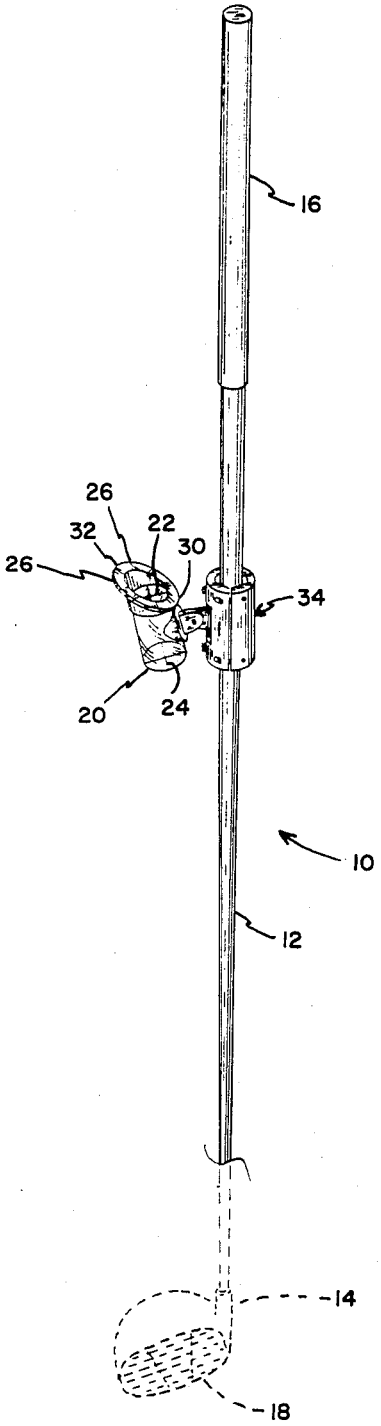
FIG. 1 is a pictorial view taken from a side showing an alignment device embodying the invention installed on a golf club.

Referring to FIG. 1 of the drawings, there is shown a golf club 10 having a shaft 12 with the driving head 14 mounted on its bottom end and a handle 16 formed for gripping on the top end. The club head has a flat surface 18 for striking the ball. The device of the pesent invention includes a cylindrical transparent barrel 20 adjustably mounted on shaft 12 in spaced-apart, generally parallel relation to the shaft. The barrel has spaced-apart alignment indicators in the form of two sets of cross hairs 22 and 24 located on the surface of the top and bottom ends, respectively, of the barrel. Mounted on the top end of the barrel is a generally tubular shading cap 26 made of a dark material, such as black plastic, which shields light from the top of the barrel and provides enhanced contrast so as to facilitate viewing of the sight picture formed by the spaced-apart sets of cross hairs. The top of the cap has an outwardly extending lip 28 (FIG. 2) which is wider at the side 30 near the golfer to further enhance viewing. Side 30 of the cap is made shorter than opposite side 32 for the same reason. A light colored contrasting coating 33 is disposed at the bottom end of the barrel below cross hairs 24, also to provide contrast, and the sets of cross hairs are of different colors, for instance, top cross hairs 22 may be black, while bottom cross hairs 24 are red so as to make them distinguishable from one another. These features combine to provide effective viewing of the sight pattern obtained during alignment.

Barrel 20 is connected to a clamping member 34 through linkages that allow movement of the barrel out of parallel with the shaft in two directions: movement of the top of the barrel toward and away from the top of the shaft, and movement of the top of the barrel to the left and right of the top of the shaft as viewed by the golfer. Clamping member 34 has shell halves 36 and 38 which encircle the shaft and which are secured together by screws 40. The clamping member is secured in fixed position on the shaft and is not movable during alignment of the barrel.

Figure 3:
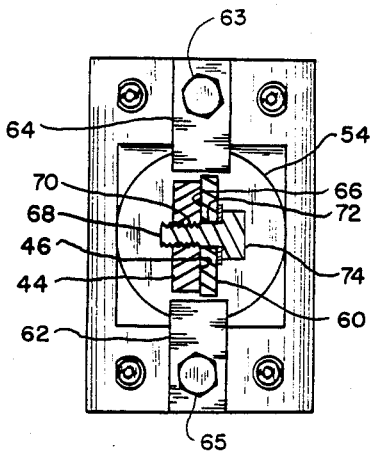
FIG. 3 is a planar view, partly in section, showing details of means for securing parts of the alignment device to one another.
Figure 4:
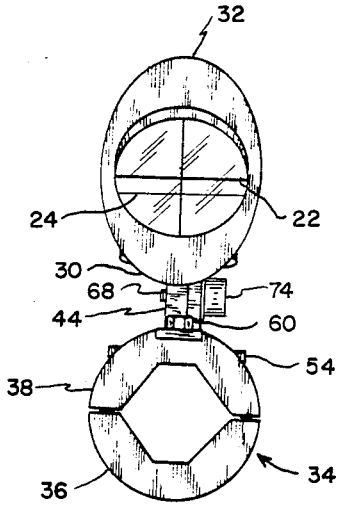
FIG. 4 is a planar view, taken from above, showing the alignment device.
Figure 2:
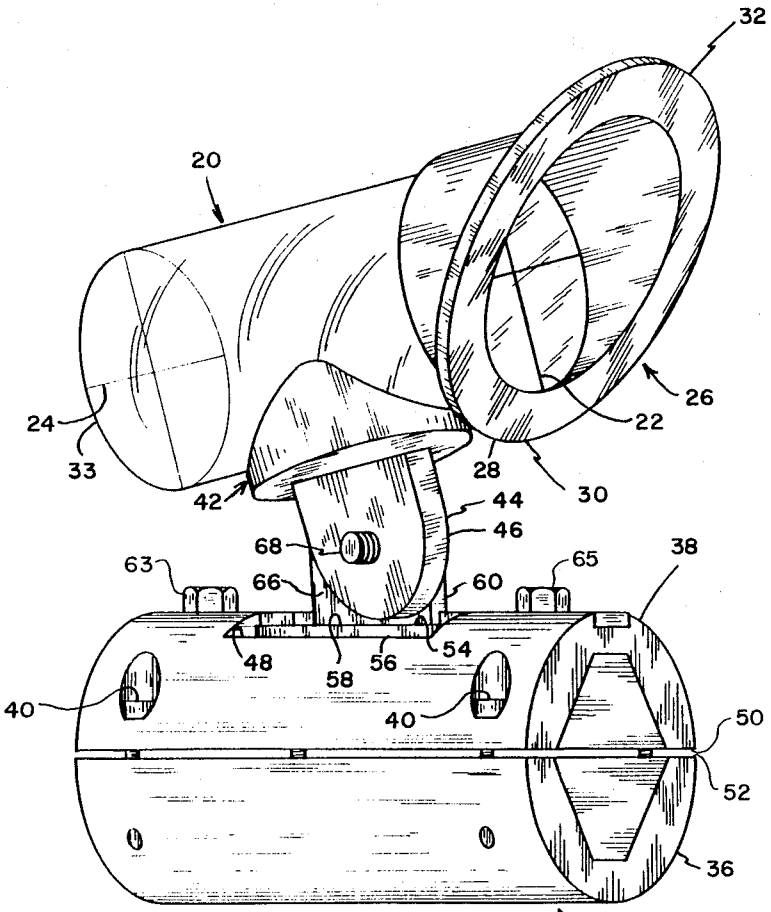
FIG. 2 is a close-up pictorial view of the alignment device.

As shown in FIGS. 2 and 3, barrel 20 has a base 42 secured in fixed relation to side 30 and a tab 44 extending normally outward from the base, the tab having a flat surface 46 co-planar with the axis of the barrel. Shell half 38 has a flat portion 48 forming a plane parallel to the plane in which edges 50, 52 of the two shell halves are in contact with one another. A disc 54 is disposed with one face 56 disposed against flat surface 46 and the other face 58 having a tab 60 extending normally outward therefrom. Flat surface 56 of disc 54 is held against flat portion 48 of the shell half by catches 62, 64 secured by bolts 63, 65 loosely enough to allow rotation of the disc during alignment, but biased tightly enough to hold the rotated position reached during alignment. Tab 60 has a flat surface 66 in contact with surface 46 of tab 44, the tabs being secured together in contact with one another by a bolt 68 extending through holes 70, 72 in the tabs and having a knob 74 for turning the bolt to releasably secure the tabs together.

Two kinds of relative motion between the club shaft and barrel are enabled by the linkage described above. The top of the barrel may be brought closer to the shaft and the bottom further away by pivoting the tab around bolt 68. Rotation of disc 54 against flat surface 48 moves the top of the barrel to the left or right of the shaft as viewed by the golfer. Thus, two axes of adjustment are provided, the first axis being normal to the club shaft and a second axis normal to the first axis.

In operation of the device, the golfer first establishes through practice his optimum stance and club position. This device is concerned only with two aspects: the angle of the club shaft with respect to the plane in which the ball lies determined by the extent to which the handle end is held higher or lower off the ground, and the extent to which the handle end is held to the golfer's left or right. Other aspects of optimum stance, such as alignment of the club face with the ball or target and placement of the golfer's feet are not directly involved in using the device, but consistency in those respects would, of course, be desirable to contribute to obtaining good results.

Figure 9:
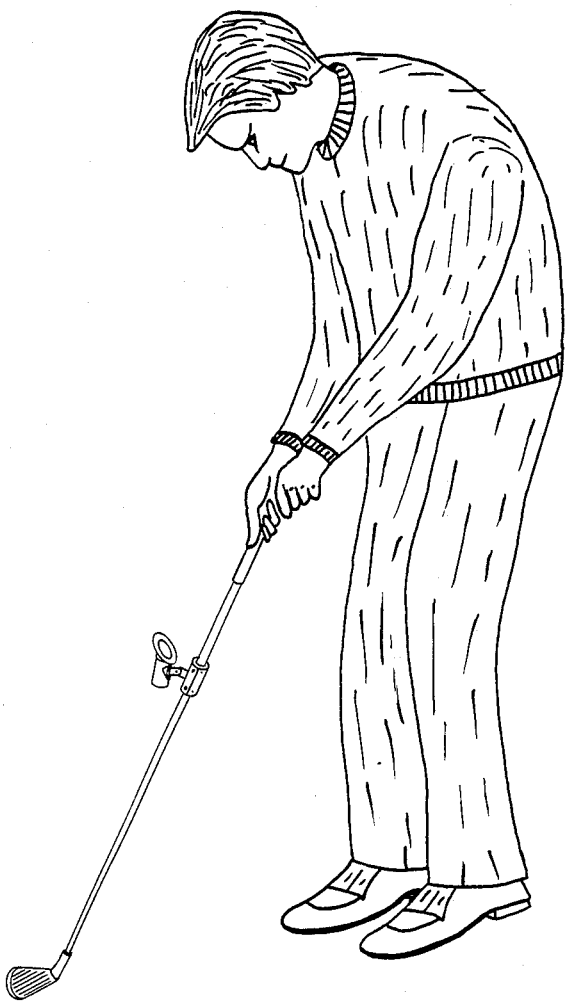
FIG. 9 is a pictorial view of the alignment device disposed for use by a golfer.

Once the golfer establishes an optimum location for the club handle when addressing the ball, and with his head in its normal position, he looks down into the barrel as shown in FIG. 9 to view the sight pattern depicted by the spaced-apart cross hairs. If the cross hairs are not in alignment with one another on a line extending downward from the golfer's eye, he moves the top of the barrel to the left or right or closer or nearer the shaft until they come into alignment so that the bottom cross hairs are masked by the top ones. This sight pattern records the golfer's optimum position, and the barrel is thereafter maintained in fixed relation to the shaft. Movement of the barrel is prevented by disc face 56 being biased against flat surface 46 by catches 62, 64 and by tightening of bolt 68 as required.

The golfer may make use of the recorded sight pattern in subsequent shots by first addressing the ball so as to provide proper alignment of the club face with the ball and target, and with his head in normal position, sighting downward to the top of the barrel. He then adjusts the position of the club handle up or down and to the left or right until the cross hairs again come into alignment with one another. This brings the golfer and club handle back into the previously determined optimum alignment.

DESCRIPTION OF ALTERNATE EMBODIMENTS

Figure 5:
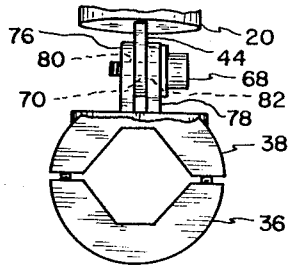
FIG. 5 is a planar view, partially cut away, showing an alternate embodiment of the invention.

FIG. 5 shows an embodiment wherein, instead of using a single tab 60 secured to base 58 of disc 56, as in FIG. 2, two tabs 76 and 78 forming a clevis are secured to base 58 and disposed to receive therebetween tab 44 which projects from barrel 20. Bolt 68 extends through holes 80 and 82 in the tabs as well as through hole 70 in opposing tab 44. This provides for a more secure adjustable connection between the barrel and clamping member.

Figure 6:
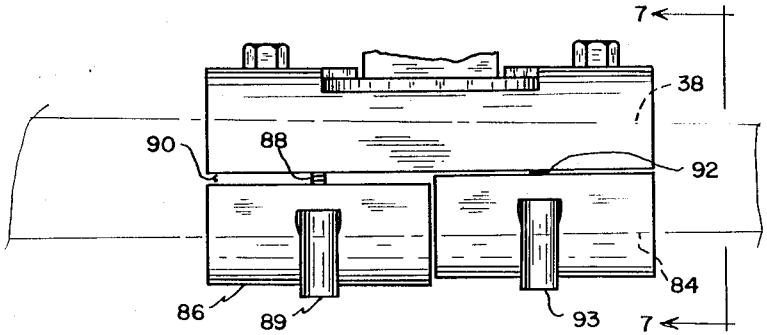
FIG. 6 is a planar view, partially cut away, showing a further embodiment.
Figure 7:
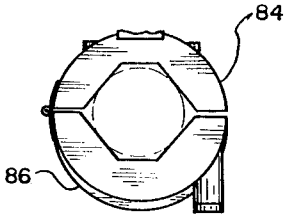
FIG. 7 is an end view taken along line 7—7 in FIG. 6.

FIGS. 6 and 7 show an embodiment wherein the shell half opposite from barrel 20, as shown by 36 of FIG. 2, is replaced by a shell half made up of split sections 84 and 86 separated from one another and separately attachable to shell half 38 so as to compensate for tapering of a golf club shaft. Upper section 86 is attachable by screw 88 having a hand-operable handle portion 89 to a position such that a gap 90 remains between shell half edges when the screws are tightened. Lower section 84 may be brought closer to shell half 38 when its screws 92 are tightened, owing to the reduced diameter of this portion of the shaft. Tightening or loosening of screw 92 may be effected by turning its manually-operable handle portion 93. This embodiment provides for more effective clamping of tapered shafts owning to better distribution of clamping pressure. Compensation for shaft tapering may also be effected by tapering the edges of one or both shell halves to an extent corresponding to shaft taper.

Figure 8:
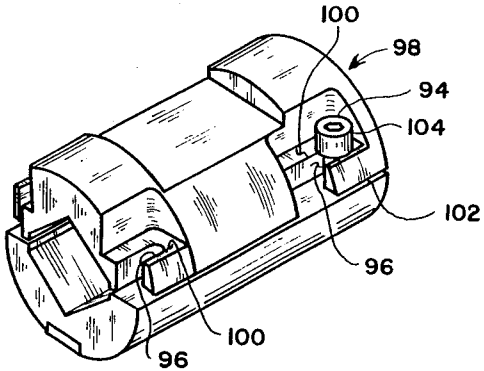
FIG. 8 is a pictorial view, partially cut away, showing yet another embodiment.

FIG. 8 shows yet another embodiment for more convenient attachment of shell halves corresponding to halves 36 and 38 of FIG. 2 which are attachable to one another by means of screws 94 at each corner that engage U-shaped slots 96 defined in the shell half 98 opposite from barrel 20. Notched-out portions of the shell half provide a surface 100 parallel to the interface 102 between shell halves. Screws 94 have heads 104, the undersides of which engage surface 100 upon tightening. These features enable shell half 98 to be slid in position for engagement.

The above-described embodiments are for illustrative purposes only and are not to be understood as limiting the scope of the invention, which is limited only as indicated by the appended claims.

I claim:

1. A device for recording a sight pattern determined by the relative position of the handle of a golf club shaft when held by a golfer addressing a ball comprising:

a sighting member having a longitudinal axis, top and bottom ends, and a plurality of spaced-apart indicators providing, when viewed from above, a predetermined sight pattern depicting alignment of said axis with the viewer's eyes;

means for securing said sighting member to said shaft in spaced-apart, generally parallel relation thereto;

said securing means including adjustable linkage means enabling movement of said sighting member so that its top may be pivoted closer to or further away from said shaft and said sighting member may be moved to the golfer's left or right until said sight pattern is visible to the viewer; and means for retaining said sighting member in adjusted position;

whereby the sighting member may be brought into a fixed position responsive to alignment of its axis with the viewer's eye and depicted by a predetermined sight pattern, location of the golf club handle for subsequent shots being reproducible by the golfer's movement of the handle until the predetermined sight pattern reappears when the sighting member is viewed by the golfer.

2. The device as defined in claim 1 wherein said sighting member comprises a generally cylindrical transparent barrel.

3. The device as defined in claim 2 wherein said indicators comprise a first set of cross hairs disposed across the top of said barrel and normal to it axis, and a second set of cross hairs disposed across the bottom of said barrel and normal to its axis, said sets of cross hairs appearing as one when viewed along a line coaxial with the barrel axis.

4. The device as defined in claim 3 including a coating contrasting with said sets of cross hairs and enclosing the bottom face thereof.

5. The device as defined in claim 4 wherein said sets of cross hairs are colored differently from one another.

6. The device as defined in claim 2 wherein said securing means comprises:

a generally tubular clamp having longitudinal shell halves adapted to fit around said shaft and being connected together in fixed position, one of the said shell halves having a flat surface on its outside between its end and parallel to said shaft;

a disc having a first face disposed for rotation against said flat surface and a second, opposite, face having a first tab secured thereto normal to said shaft;

a second tab secured to said barrel and disposed normal to the barrel axis;

means for movably securing said tabs together so as to allow movement of the top of said barrel toward or away from said shaft; and rotation of said disc against said flat surface, allowing movement of the top of said barrel to the left or right of the top of said clamp.

7. The device as defined in claim 6 including a plurality of catches biasing said first face of said disc against said flat surface.

8. The device as defined in claim 7 including a tubular light-shielding cap secured to the top end of said barrel in coaxial relation therewith.

9. The device as defined in claim 8 wherein said cap member is longer on the side of the barrel away from said shaft and shorter on the other side, providing a diagonally inclined end edge region, thus enhancing sight pattern recognition.

10. The method of reproducing for a subsequent shot a predetermined optimum location of a golf club handle end when held by a golfer in addressing a ball comprising:

providing a sighting member having a longitudinal axis and a plurality of indicators which, when viewed from above along said axis, produce a predetermined sight pattern, said sighting member being movably secured to the shaft of said club in spaced-apart, generally parallel relation thereof;

addressing said ball and holding said club handle in said optimum location;

viewing said sighting member from above and adjusting the location of its axis until said indicators provide a predetermined pattern when viewed from above;

fixing the adjusted location of said sighting member;

addressing the ball for a subsequent shot;

viewing said sight member with the golfer's eye in the same relative position as when said adjusted location was fixed; and moving said club handle up or down or to the left or right until said sight pattern reappears, whereby said optimum location is reproduced.

* * * * *